US007552665B1

(12) United States Patent
Dickson

(10) Patent No.: US 7,552,665 B1
(45) Date of Patent: Jun. 30, 2009

(54) VALVE WRENCH STABILIZER

(76) Inventor: Robert J. Dickson, P.O. Box 400, Bismarck, ND (US) 58502-0400

( * ) Notice: Subject to any disclaimer, the term of this patent is extended or adjusted under 35 U.S.C. 154(b) by 9 days.

(21) Appl. No.: 11/897,951

(22) Filed: Sep. 4, 2007

(51) Int. Cl.
*B25B 23/00* (2006.01)

(52) U.S. Cl. ..... 81/462

(58) Field of Classification Search ..... 81/462, 81/176.1, 176.15, 176.2; 137/364–370
See application file for complete search history.

(56) References Cited

U.S. PATENT DOCUMENTS

| | | | | | |
|---|---|---|---|---|---|
| 407,955 | A * | 7/1889 | Kallaher et al. | ..... | 137/369 |
| 820,616 | A * | 5/1906 | Batt | ..... | 137/365 |
| RE23,201 | E * | 2/1950 | Price | ..... | 81/462 |
| 5,316,040 | A * | 5/1994 | Townsend et al. | ..... | 137/365 |
| 6,305,410 | B1 * | 10/2001 | Cook et al. | ..... | 137/363 |

* cited by examiner

*Primary Examiner*—Hadi Shakeri

(57) ABSTRACT

A valve wrench stabilizer which opens and closes around the valve wrench rod and then lowers into the access pipe to stabilize the valve wrench when opening or closing an underground valve.

8 Claims, 3 Drawing Sheets

VALVE WRENCH STABILIZER

BACKGROUND OF THE INVENTION

1. Field of the Invention

The present invention relates generally to a device for stabilizing a valve key or wrench which is utilized for servicing subterranean valves employed in underground utility pipelines.

2. Description of Related Art

Valves are used for many purposes in a water or sewer distribution system. They can shut off, turn on, and otherwise regulate the flow of water, reduce pressure, provide air and vacuum relief, blow off or drain water from parts of the system, and prevent backflow. Valves also have to be exercised once or twice a year to prevent erosion and to keep the valves in good operating condition. Valves are one of the most important devices available in operating the water distribution system.

The valves are located beneath the frost line, which is 4-8 feet deep. To turn the water on or off, the operators use a valve key or wrench which includes a handle, a rod, and at its distal end, a socket. The socket is adapted to matingly and releasably engage the valve. Examples of valve keys are set forth in U.S. Pat. No. 7,000,897 to Chick; U.S. Pat. No. 6,776,068 to Reuschel, et al; and U.S. Pat. No. 6,364,285 to Stinnett.

To open the valve, an individual must insert the rod and socket into a vertical access pipe which extends from ground level to the underground valve. The circumference of the access pipe is significantly greater that the circumference of the valve wrench rod. Once the valve wrench socket has engaged the valve, the handle of the valve wrench can be turned in a clockwise or counter clockwise direction to open or close the valve.

Manually turning of the valve wrench can be an exhausting and slow task, especially on older valves that require high torque and many rotations due to corrosion. It can also increase the risk of injury to the operators. Moreover, due to the substantial difference between the circumferences of the access pipe and the valve wrench, the valve wrench will become unstable resulting in delay, damage to the valve, and possible injury.

Accordingly, it is the primary object of the present invention to provide a durable, inexpensive and multi-use valve wrench stabilizer which can maintain the valve wrench rod in proper vertical alignment with the valve so as to prevent the valve wrench socket from inadvertently disengaging from the valve.

SUMMARY OF THE INVENTION

A valve wrench stabilizer apparatus according to the present invention includes a pair of half circle plates which plates are rotatably joined by a spring and a pin assembly. Attached to the front side of each plate is a handle for easily rotating the joined plates to an open or closed position. At the midpoint of the inside or straight edge of each plate is a corresponding half circle opening. When the joined plates are in a closed position, the midpoint openings form a circular opening. When in use, the joined plates are rotated open and the rod of the valve wrench is inserted into the midpoint openings. The valve wrench rod is inserted into the access pipe with the valve wrench stabilizer placed within the coupling at the top end of the access pipe. Once the valve wrench socket is engaged with the valve, the user can begin rotating the valve wrench and avoid the problem of the socket being unintentionally disengaged from the valve.

Therefore, a general object of this invention is to provide a valve wrench stabilizer which can be quickly and easily used with a valve wrench.

A further objective of this invention is to provide a valve wrench stabilizer which can be used with a variety of valve wrenches.

It is the further object of the present invention to provide a valve wrench stabilizer which is constructed of durable materials.

It is the further object of the present invention to provide a valve wrench stabilizer which avoids the unintended disengagement of the valve wrench socket from the valve.

It is the further object of the present invention to provide a valve wrench stabilizer which provides the operator with a smoother rotation of the valve wrench.

It is another object of the present invention to provide a valve wrench stabilizer which reduces valve wrench operator fatigue and injury.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

DETAILED DESCRIPTION OF THE PREFERRED EMBODIMENTS

The present invention and the various features and advantageous details thereof are explained more fully with reference to the non-limiting embodiments described in the following description.

Figure 1:
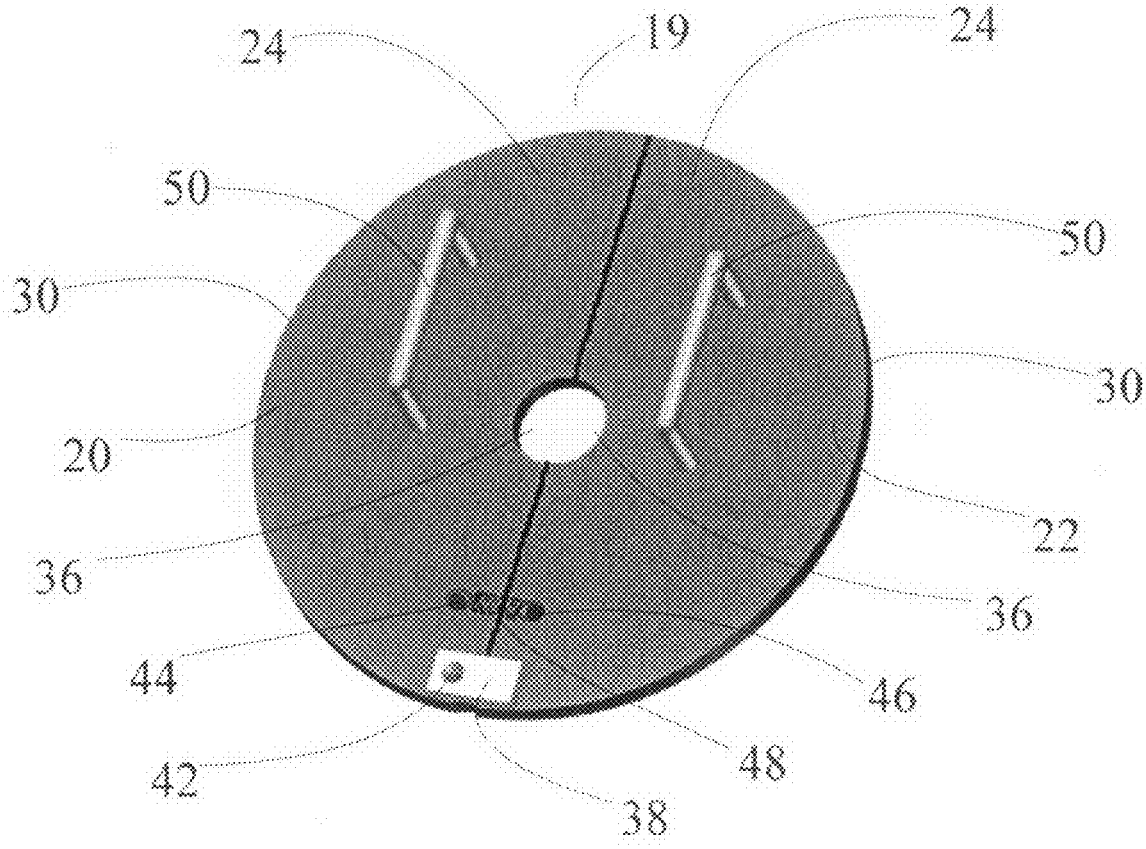
FIG. 1 is a top perspective view of a closed valve wrench stabilizer in accordance with the preferred embodiments of the present invention.
Figure 2:
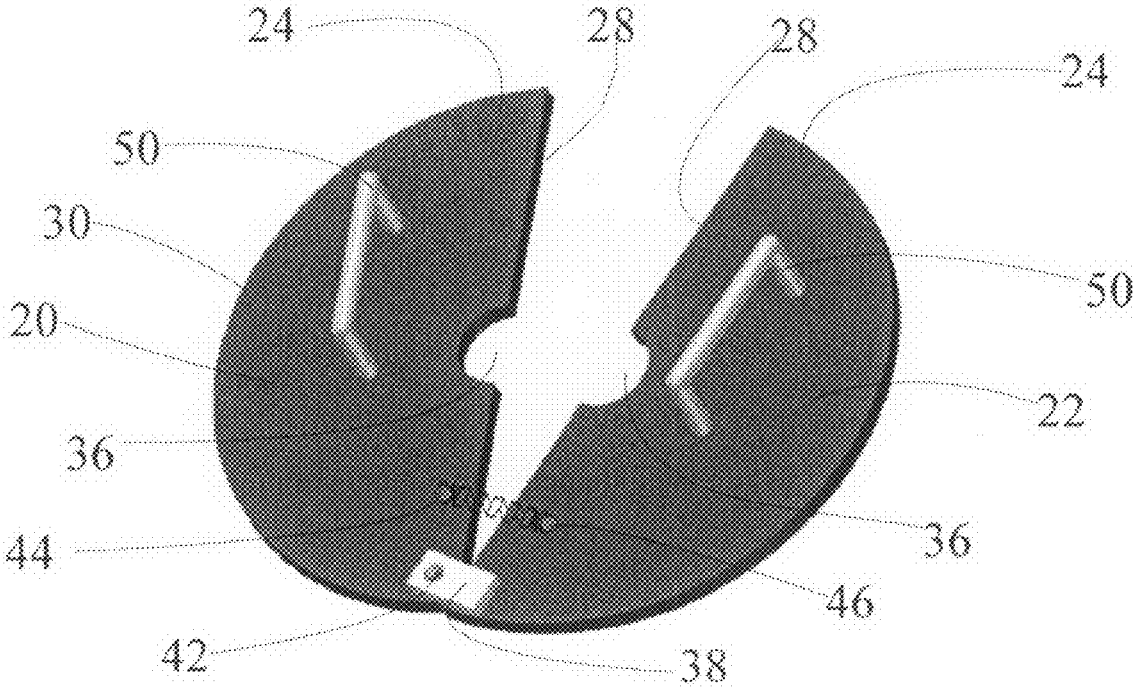
FIG. 2 is a top perspective view of an open valve wrench stabilizer in accordance with the preferred embodiments of the present invention.
Figure 3:
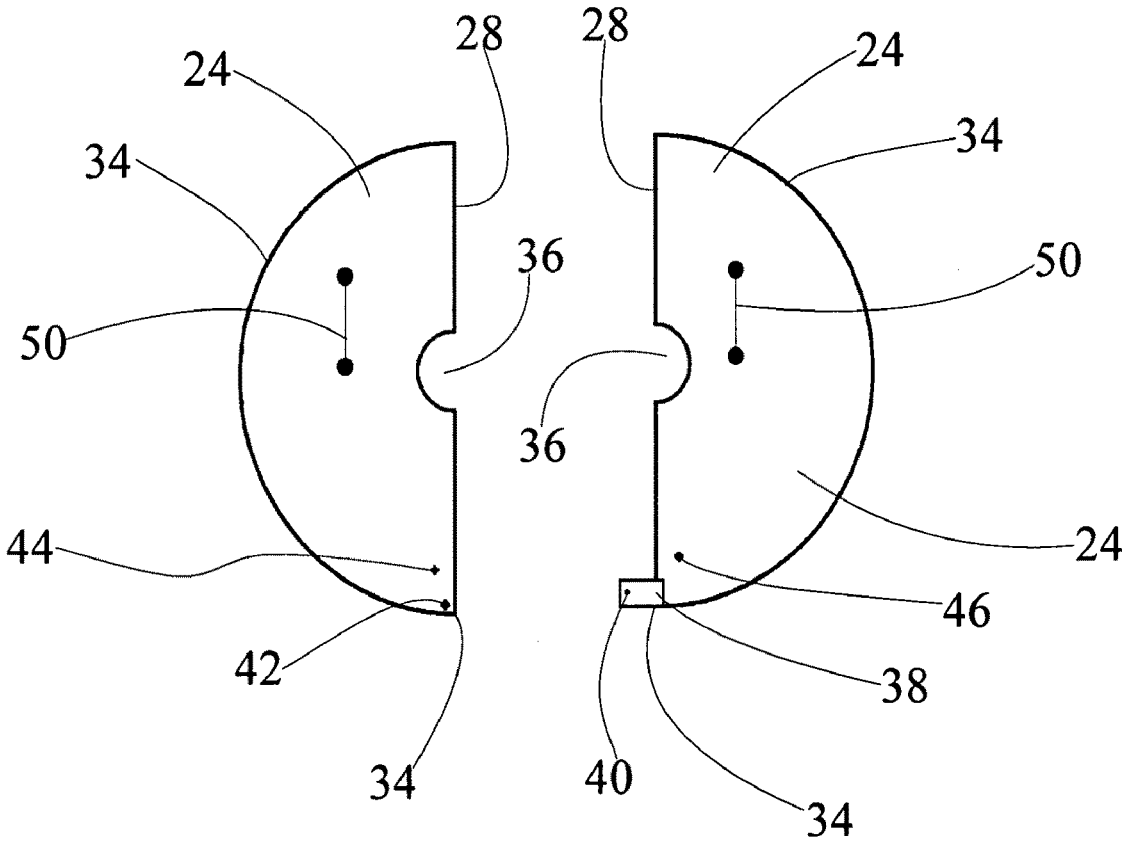
FIG. 3 is a perspective view of the front side of the plates of the valve wrench stabilizer in accordance with the preferred embodiments of the present invention.
Figure 4:
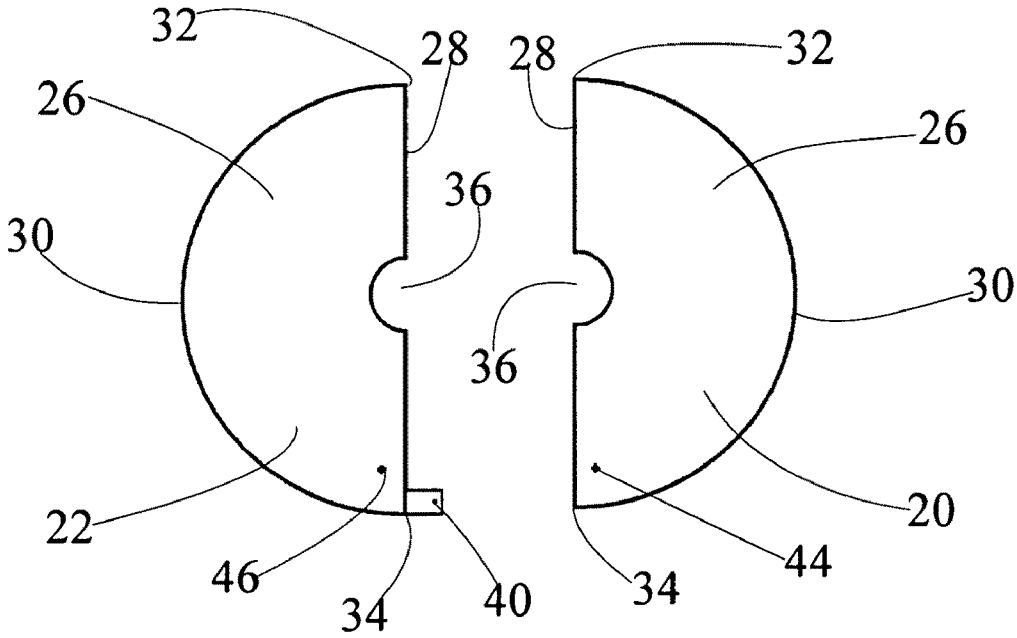
FIG. 4 is a perspective view of the back side of the plates of the valve wrench stabilizer in accordance with the preferred embodiments of the present invention.
Figure 5:
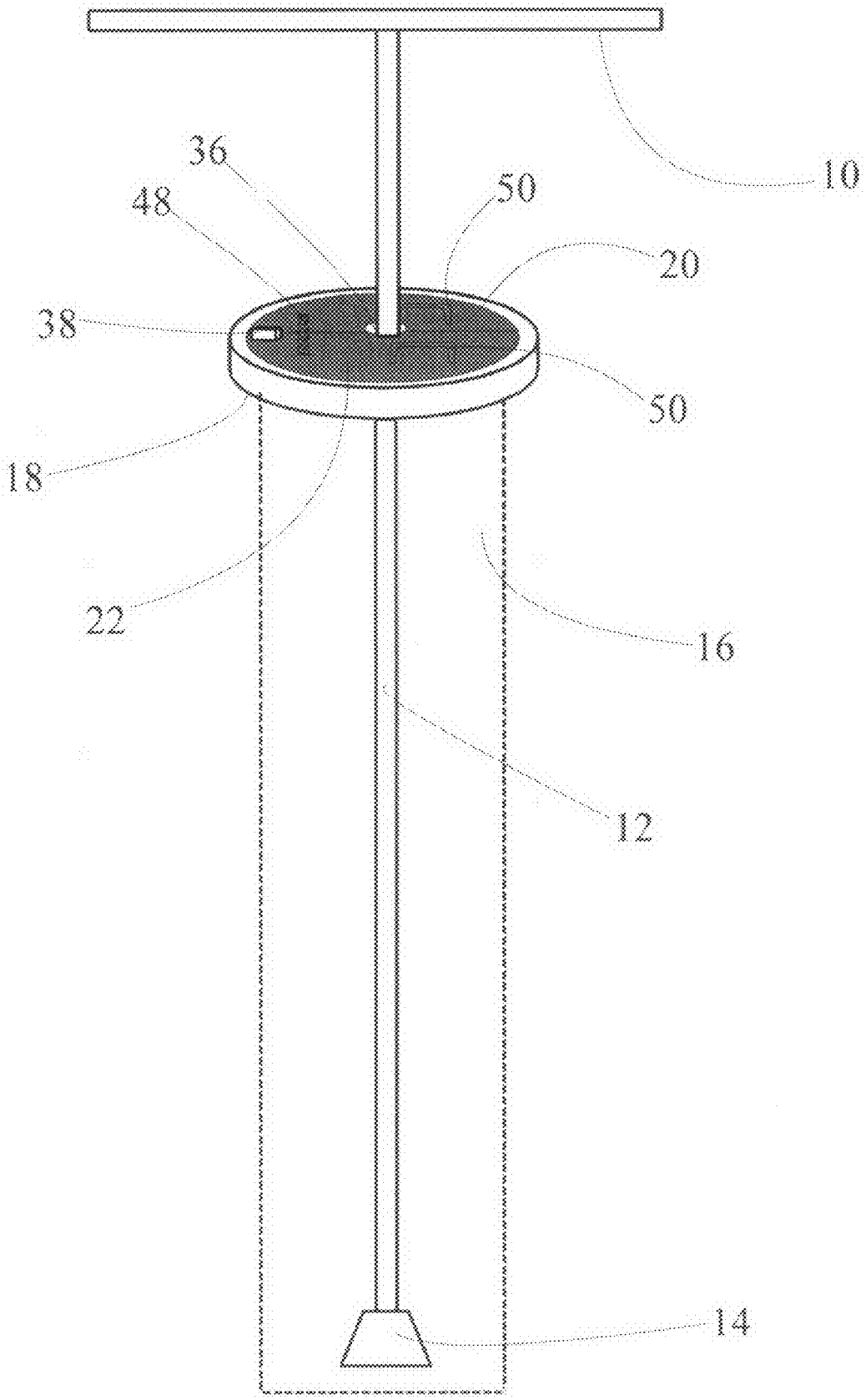
FIG. 5 is a side perspective view of the valve wrench stabilizer with a valve wrench and access pipe.

FIGS. 1 through 5 show a device of the present invention which can be used to stabilize a valve wrench when the valve wrench is being utilized to service a subterranean valve employed in an underground utility pipeline. The valve wrench includes a handle 10, a rod 12, and at its distal end, a socket 14. The socket 14 is adapted to matingly and releasably engage the valve.

The underground valve is accessed through a vertical access pipe 16 which extends from ground level to the underground valve. Fixedly attached to the top end of the access pipe 16 is a coupling 18. The coupling 18 has a greater circumference than the access pipe 16.

The circumference of the access pipe 16 and coupling 18 is significantly greater that the circumference of the valve wrench rod 12. Due to the substantial difference between the circumferences of the access pipe 16 and the valve wrench rod 12, the valve wrench will often times become unstable resulting in delay, damage to the valve, and possible injury to the operator.

The present invention resolves this problem by providing an apparatus which stabilizes the valve wrench when being used to open or close an underground valve. Referring to FIGS. 1, 2, 3, and 4, the valve wrench stabilizer 19 is comprised of a first half-circle plate 20 and a second half-circle plate 22. Each plate 20, 22, has a front side 24, a back side 26, a plane side 28, a bowed side 30, a first end 32 and a second end 34. The circumference of the plates, 20, 22, when joined, fit within the coupling 18 of the access pipe 16.

Fixedly attached to the front side 24 of the second plate 22, adjacent to its second end 34, is a pivot pin bracket 38. The pivot pin bracket 38 is rectangular shaped with one-half of the pivot pin bracket 38 fixedly attached to the front side 24 of the second plate 22 and one-half extending beyond the plane side 28 of the second plate 22. A circular opening 40 is contained on that portion of the pivot pin bracket 38 which extends beyond the plane side 28 of the second plate 22.

The first end of a vertical pin 42, having a first end and a second end, is fixedly attached to the front side 24 of the first plate 20 adjacent to the first plate's 20 second end 34. The second end of the pin 42 is inserted into the circular opening 40 of the pivot bin bracket 38. A cap is attached to the second end of the pin 42 so as to maintain the rotatable connection between the pivot pin bracket 38 and the pin 42. In an alternative embodiment of the present invention, a screw (not shown) can be used in place of the vertical pin 42. The screw would be rotatably maintained within the circular opening 40 of the pivot bin bracket 38 and removably attached to the front side 24 of the first plate 20.

Adjacent to the vertical pin 42 on the first plate 20 is a first annular opening 44 and adjacent to the pivot pin bracket 38 on the second plate 22 is a second annular opening 46. The first end of a spring 48 is removably attached to the first annular opening 44 and the second end of the spring 48 is removably attached to the second annular opening 46. The spring 48 causes the first and second plates 20, 22 to rotate about the pin 42 to a closed position wherein the plane sides 28 of the first and second plates 20, 22 are temporarily joined.

When in use, the joined plates 20, 22 are rotated about the pin 42 to an open position and the valve wrench rod 12 is inserted into the semi-circular openings 36. The valve wrench rod 12 is then inserted into the access pipe 16 with the valve wrench stabilizer 19 placed within the coupling 18. Once the valve wrench socket 14 is engaged with the valve, the user can rotate the valve wrench handle 10 and avoid the problem of the socket 14 being unintentionally disengaged from the valve.

The components mentioned herein need not be formed in the disclosed shapes, or assembled in the disclosed configuration, but could be provided in virtually any shape, and assembled in virtually any suitable configuration. It is intended that the appended claims cover all such additions, modifications and rearrangements.

| Index of Elements for Valve Wrench Stabilizer | |
|---|---|
| 10 | Valve Wrench Handle |
| 12 | Valve Wrench Rod |
| 14 | Valve Wrench Socket |
| 16 | Access Pipe |
| 18 | Access Pipe Coupling |
| 19. | Valve Wrench Stabilizer |
| 20 | First Half Circle Plate |
| 22 | Second Half Circle Plate |
| 24 | Plate Front Side |
| 26 | Plate Back Side |
| 28 | Plate Plane Side |
| 30 | Plate Bowed Side |
| 32 | Plate First End |
| 34 | Plate Second End |

-continued

| Index of Elements for Valve Wrench Stabilizer | |
|---|---|
| 36 | Semi-Circular Opening |
| 38 | Pivot Pin Bracket |
| 40 | Bracket Circular Opening |
| 42 | Pin |
| 44 | First Annular Opening |
| 46 | Second Annular Opening |
| 48 | Spring |
| 50 | Handle |

What is claimed is:

1. A valve wrench stabilizer, comprising:

a first half circle plate and a second half circle plate with each plate having a front side, a back side, a plane side, a bowed side, a first end and a second end;

a semi-circular impression maintained on the plane side of each plate which semi-circular impressions, when the plates are joined, defines an opening for the rod of a valve wrench;

a pivot pin bracket with one-half of the pivot pin bracket fixedly attached to the front side of the second plate and one-half, containing a circular opening, extending beyond the plane side of the second plate;

a vertical pin having a first end and a second end with the first end fixedly attached to the front side of the first plate and the second end rotatably maintained within the circular opening of the pivot pin bracket; and a spring removably attached to the first and second plates through annular openings.

2. The device of claim 1, wherein a cap is attached to the second end of the vertical pin so as to maintain the rotatable connection between the pivot pin bracket and the vertical pin.

3. The device of claim 1, wherein fixedly attached to the front side of each plate is a handle.

4. The device of claim 1, wherein the circumference of the plates, when joined, fits within the coupling of an access pipe.

5. A valve wrench stabilizer, comprising:

a first half-circle plate and a second half-circle plate with each plate having a front side, a back side, a plane side, a bowed side, a first end and a second end;

a semi-circular impression maintained on the plane side of each plate which semi-circular impressions, when the plates are joined, defines an opening for the rod of a valve wrench;

a rectangular shaped pivot pin bracket with one-half of the pivot pin bracket fixedly attached to the front side of the second plate adjacent to the second plate's second end and one-half of the pivot pin bracket extending beyond the plane side of the second plate and containing a circular opening;

a vertical pin having a first end and a second end with the first end fixedly attached to the front side of the first plate adjacent to the first plate's second end and the second end of the vertical pin rotatably contained within the circular opening of the pivot bin bracket;

a spring which is removably attached to the first and second plates through a first annular opening located adjacent to the vertical pin on the first plate and a second annular opening located adjacent to the pivot pin bracket on the second plate;

a handle fixedly attached to the front side of the first plate and a handle fixedly attached to the front side of the second plate.

6. The device of claim 5, wherein the circumference of the first and second plates, when joined, fit within the coupling of an access pipe.

7. The device of claim 5, wherein a cap is attached to the second end of the vertical pin so as to maintain the rotatable connection between the pivot pin bracket and the vertical pin.

8. The device of claim 5, wherein the spring causes the first and second plates to rotate about the pin to a closed position wherein the plane sides of the first and second plates are temporarily joined.

* * * * *